US006686894B2

(12) United States Patent
Okuno et al.

(10) Patent No.: US 6,686,894 B2
(45) **Date of Patent: *Feb. 3, 2004**

(54) IMAGE DISPLAY APPARATUS AND METHOD

(75) Inventors: Yoshiaki Okuno, Tokyo (JP); Jun Someya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 26 days.

This patent is subject to a terminal disclaimer.

(21) Appl. No.: 10/158,872

(22) Filed: Jun. 3, 2002

(65) Prior Publication Data

US 2002/0145618 A1 Oct. 10, 2002

Related U.S. Application Data

(62) Division of application No. 09/522,396, filed on Mar. 9, 2000, now Pat. No. 6,407,723.

(30) Foreign Application Priority Data

Dec. 15, 1999 (JP) ..... 11-355553

(51) Int. Cl.[7] ..... G06G 5/00
(52) U.S. Cl. ..... 345/3.2; 345/671; 345/213
(58) Field of Search ..... 345/1.1, 3.1, 3.2, 345/3.3, 3.4, 660, 671, 213, 204

(56) References Cited

U.S. PATENT DOCUMENTS 5,517,612 A 5/1996 Dwin et al.
5,710,573 A 1/1998 Hung et al.
5,990,860 A 11/1999 Takeuchi
6,014,125 A 1/2000 Herbert
6,252,576 B1 6/2001 Nottingham
6,330,002 B1 12/2001 Yamada

FOREIGN PATENT DOCUMENTS

JP 8-129356 5/1996
JP 10-334227 12/1998

*Primary Examiner*—Kent Chang
(74) *Attorney, Agent, or Firm*—Birch, Stewart, Kolasch & Birch, LLP

(57) ABSTRACT

An image display apparatus and method having a synchronizing signal decimation circuit for performing decimation of vertical synchronizing signals, an image decimation circuit for performing decimation of image data, an image scale-up circuit for scaling up the decimated image data, a display panel for displaying an image, a driving circuit for causing the display panel to sequentially display individual frames of image according to the scaled-up image data in synchronization with the decimated vertical synchronizing signals, and a controller having information of a scaling factor of the image scale-up circuit, vertical synchronizing signals to be discarded by the synchronizing signal decimation circuit, and image data to be discarded by the image decimation circuit. The controller controls operation of the synchronizing signal decimation circuit, the image decimation circuit, the image scale-up circuit, and the driving circuit according to the information.

8 Claims, 9 Drawing Sheets

IMAGE DISPLAY APPARATUS AND METHOD

This application is a divisional of application Ser. No. 09/522,396, filed on Mar. 9, 2000, now U.S. Pat. No. 6,407,723 the entire contents of which are hereby incorporated by reference and for which priority is claimed under 35 U.S.C. §120; and this application claims priority of Application No. 11-355553/99 filed in Japan on Dec. 15, 1999 under 35 U.S.C. §119.

BACKGROUND OF THE INVENTION

The present invention relates to an image display apparatus and method such as a monitor or a data projector having a matrix display device (hereinafter referred to as a display panel) such as a liquid crystal display panel, a digital micromirror device (DMD), a field emission display (FED), a plasma display panel (PDP), or an LED panel. More specifically, the present invention relates to an image display apparatus and method that displays a scaled-up image if an image size of an input image signal is smaller than a size of an effective display area of the display panel.

FIG. 7 is a diagram showing configuration of a prior art image display apparatus, which is disclosed in Japanese Patent Kokai Publication No. 10-334227 published on Dec. 18, 1998. In the image display apparatus 100 shown in FIG. 7, an image signal is supplied from a terminal 101, and a dot clock SCLK for the image signal is supplied from a terminal 102. The image signal supplied from the terminal 101 is input to a control unit 103 and a time-base converter 104. The dot clock SCLK supplied from the terminal 102 is input to the time-base converter 104. The control unit 103 outputs an output clock DCLK so that a scaled-up image is generated at a frame rate matching a rate at which the input image signal is received. The clock DCLK output by the control unit 103 is supplied to the time-base converter 104, an interpolation circuit 105, and a panel controller 106. Then, the control unit 103 outputs a buffer control signal BANK for controlling a line buffer in the time-base converter 104. The buffer control signal BANK output by the control unit 103 is supplied to the time-base converter 104. Moreover, the control unit 103 outputs a modifier signal Q for determining pixel data used for interpolation and a phase value signal PHASE for determining an interpolation coefficient. The modifier signal Q output from the control unit 103 is input to the time-base converter 104 and the interpolation circuit 105, and the phase value signal PHASE is supplied to the interpolation circuit 105.

The time-base converter 104 receives the pixel data for the input image in synchronization with the dot clock SCLK, and outputs the received pixel data in synchronization with the output clock DCLK on a different time base according to the buffer control signal BANK supplied from the control unit 103. The pixel data output from the time-base converter 104 is image data scaled up by copying (or repeating) the pixel data. The scaled-up pixel data output from the time-base converter 104 is supplied to the interpolation circuit 105. The interpolation circuit 105 performs predetermined interpolation of the pixel data of the scaled-up image, according to the modifier signal Q and the phase value signal PHASE, and outputs the results of interpolation. The pixel data of the scaled-up image subjected to interpolation and output by the interpolation circuit 105 is supplied to the panel controller 106. The panel controller 106 outputs the scaled-up image subjected to interpolation to the display panel 107 in a signal format compatible with the input interface of the display panel 107. The display panel 107 therefore displays the scaled-up image subjected to interpolation according to the output of the panel controller 106.

FIG. 8 is a block diagram showing configuration of a prior art image display apparatus, which is disclosed in Japanese Patent Kokai Publication No. 08-129356 published on May 21, 1996. In the image display apparatus 200 shown in FIG. 8, an image signal is input from a terminal 201. The input image signal is supplied to a first arithmetic circuit 202 and a control unit 203. The control unit 203 detects resolution of the image data from a synchronizing signal of the image signal and outputs a scaling factor CZ calculated from a ratio of the detected result to the resolution of the display panel 206. The control unit 203 also outputs a horizontal interpolation control signal CH and a vertical interpolation control signal CV, according to a calculated scaling factor CZ. Moreover, the control unit 203 outputs a memory control signal CM for controlling a write timing and a read timing of the frame memory 204. The control unit 203 further outputs the display control signal CP for the display panel 206. The scaling factor CZ output by the control unit 203 is supplied to the first arithmetic circuit 202 and the second arithmetic circuit 205. The horizontal interpolation control signal CH output by the control unit 203 is supplied to the first arithmetic circuit 202, and the vertical interpolation control signal CV is supplied to the second arithmetic circuit 205. The memory control signal CM output by the control unit 203 is supplied to the frame memory 204. The display control signal CP output by the control unit 203 is supplied to the display panel 206.

The first arithmetic circuit 202 performs interpolation of the input image data in consecutive dot units, according to the scaling factor CZ and the horizontal interpolation control signal CH, and outputs the image data scaled up in the horizontal direction. The horizontally scaled-up image data output by the first arithmetic circuit 202 is supplied to the frame memory 204. The frame memory 204 stores the horizontally scaled-up image data of one screen according to the memory control signal CM, and the stored image data is read out. The horizontally scaled-up image data read from the frame memory 204 is input to the second arithmetic circuit 205. The second arithmetic circuit 205 performs interpolation of the image data of consecutive two lines of the horizontally scaled-up image according to the scaling factor CZ and the vertical interpolation control signal CV. If the scaled-up image data has a lower resolution than the display panel 206, a display area that has no image data on the display panel 206 is replaced with monochromatic image data. The scaled-up image data output by the second arithmetic circuit 205 is supplied to the display panel 206. The display panel 206 displays the scaled-up image data according to the display control signal CP and displays monochromatic data in areas without image data.

Owing to the configurations as described above, the above-mentioned prior art image display apparatuses have problems as described below.

FIGS. 9A and 9B are diagrams for explaining the image display method of the prior art image display apparatus 100 shown in FIG. 7. FIG. 9A shows the numbers (720 pixels wide by 400 pixels high) of horizontal and vertical pixels of the input image signal, and FIG. 9B shows the numbers (1024 pixels wide by 768 pixels high) of horizontal and vertical pixels of the displayed image. In this example, a horizontal scaling factor is 1.42 (=1024 pixels/720 pixels), and a vertical scaling factor is 1.92 (=768 pixels/400 pixels). Accordingly, as shown in FIG. 9B, vertically distorted (vertically elongated) image is displayed. If the display panel 107 and the input image have different aspect ratios, the prior art image display apparatus 100 shown in FIG. 7 cannot display a correct scaled-up image with the same aspect ratio as that of the input image.

Unlike the image display apparatus 100 shown in FIG. 7, the prior art image display apparatus 200 shown in FIG. 8 is freed from the impossibility of maintaining the aspect ratio of the input image. However, a frame memory for one screen is needed, which results in very high cost and high difficulty in integrating the signal processing circuit other than display panel into an LSI chip.

SUMMARY OF THE INVENTION

It is an object of the present invention to provide a low-cost image display apparatus and method that can display a scaled-up image maintaining the aspect ratio of the input image even if the display panel and the input image have different aspect ratios.

According to the present invention, the image display apparatus comprises: a synchronizing signal decimation circuit for performing decimation of input vertical synchronizing signals to output decimated vertical synchronizing signals; an image decimation circuit for performing decimation of input image data to output decimated image data; an image scale-up circuit for scaling up the decimated image data to output scaled-up image data; a display panel for displaying an image; a driving circuit for causing the display panel to sequentially display individual image frames according to the scaled-up image data in synchronization with the decimated vertical synchronizing signals; and a controller having information of a scaling factor of the image scale-up circuit, vertical synchronizing signals to be discarded by the synchronizing signal decimation circuit, and image data to be discarded by the image decimation circuit, the controller controlling operation of the synchronizing signal decimation circuit, the image decimation circuit, the image scale-up circuit, and the driving circuit according to the information.

Further, the image display apparatus may further comprise a delay circuit for performing delay processing on the vertical synchronizing signals to output delayed vertical synchronizing signals to the driving circuit.

Furthermore, the controller may determine the scaling factor of the image scale-up circuit according to a size of the input image data for a single frame and a size of an effective display area of the display panel.

The controller may also determine vertical synchronizing signals to be discarded by the synchronizing signal decimation circuit and image data to be discarded by the image decimation circuit according to a size of the input image data for a single frame, a size of an effective display area of the display panel, and a frequency of the input vertical synchronizing signals.

Moreover, the controller may determine vertical synchronizing signals to be discarded by the synchronizing signal decimation circuit, a delay time by the delay circuit, and image data to be discarded by the image decimation circuit according to a size of the input image data for a single frame, a size of an effective display area of the display panel, a frequency of the input vertical synchronizing signals, and an image display position in the effective display area of the display panel.

In addition, in the decimation performed by the image decimation circuit, the image decimation circuit selects a predetermined frame among first to N-th frames of sequentially input image data, N representing a frame number which is a certain integer not smaller than 2, outputs the selected frame of image data, and discards image data other than the selected frame of image data, in the decimation by the synchronizing signal decimation circuit, the synchronizing signal decimation circuit selects a predetermined frame among first to N-th frames of sequentially input vertical synchronization signals, outputs the selected frame of vertical synchronizing signal, and discards vertical synchronizing signals other than the selected frame of vertical synchronizing signal, and a frame number of the selected frame of image data is different from a frame number of the selected frame of vertical synchronizing signal.

The image display apparatus may further comprise an image data adding circuit for displaying a certain color at an area other than the image based on the image data in the effective display area of the display panel.

Further, the image display apparatus may further comprise an image data adding circuit for displaying a message indicating that a displayed image is based on the decimated vertical synchronizing signals and the decimated image data when the image decimation circuit performs decimation of the image data.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIGS. 4A and 4B are diagrams for explaining an image display method of the image display apparatus of the first embodiment, wherein FIG. 4A shows numbers of horizontal and vertical pixels of the input image signal, and FIG. 4B shows numbers of vertical and horizontal pixels of the display panel, displayed image, and margins;

FIGS. 9A and 9B are diagrams for explaining the image display method of the prior art image display apparatus shown in FIG. 7, wherein FIG. 9A shows the numbers of horizontal and vertical pixels of the input image signal, and FIG. 9B shows the numbers of horizontal and vertical pixels of the displayed image.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
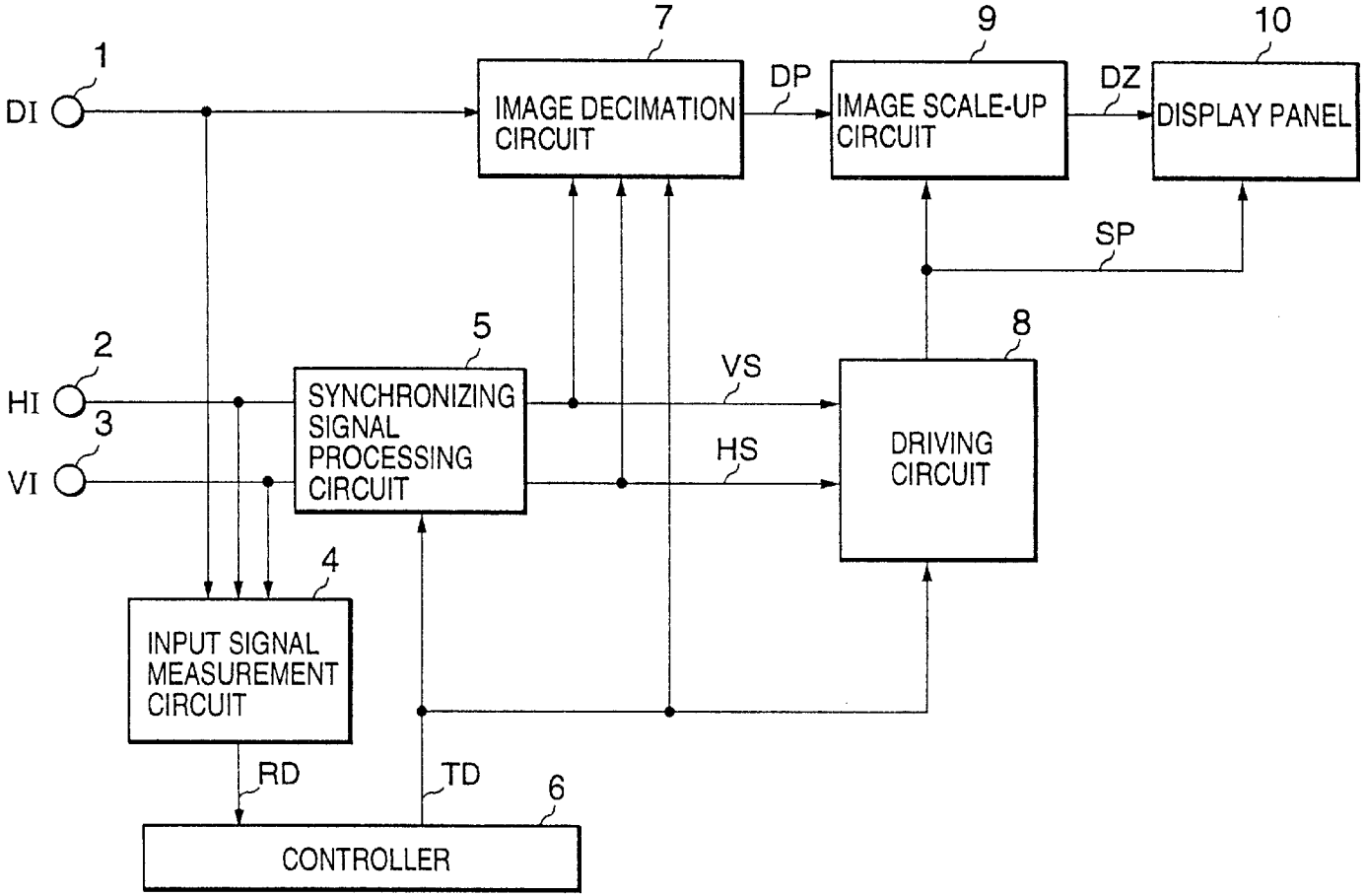
FIG. 1 is a block diagram showing configuration of an image display apparatus according to a first embodiment of the present invention.

FIG. 1 is a block diagram showing configuration of an image display apparatus according to a first embodiment of the present invention. As shown in FIG. 1, the image display apparatus of the first embodiment comprises terminals 1, 2, and 3, an input signal measurement circuit 4, a synchronizing signal processing circuit 5, a controller 6, an image decimation circuit 7, a driving circuit 8, an image scale-up circuit 9, and a display panel 10. In FIG. 1, DI represents an input image signal, HI represents an input horizontal synchronizing signal, and VI represents an input vertical synchronizing signal. Further, HS represents a horizontal synchronizing signal processed by the synchronizing signal processing circuit 5, VS represents a vertical synchronizing signal processed by the synchronizing signal processing circuit 5, DP represents an image signal processed by the image decimation circuit 7, DZ represents an image signal processed by the image scale-up circuit 9, SP represents a drive signal for the display panel 10, and TD represents a control signal. Furthermore, RD represents data such as input signal measurement results generated by the input signal measurement circuit 4.

Figure 2:
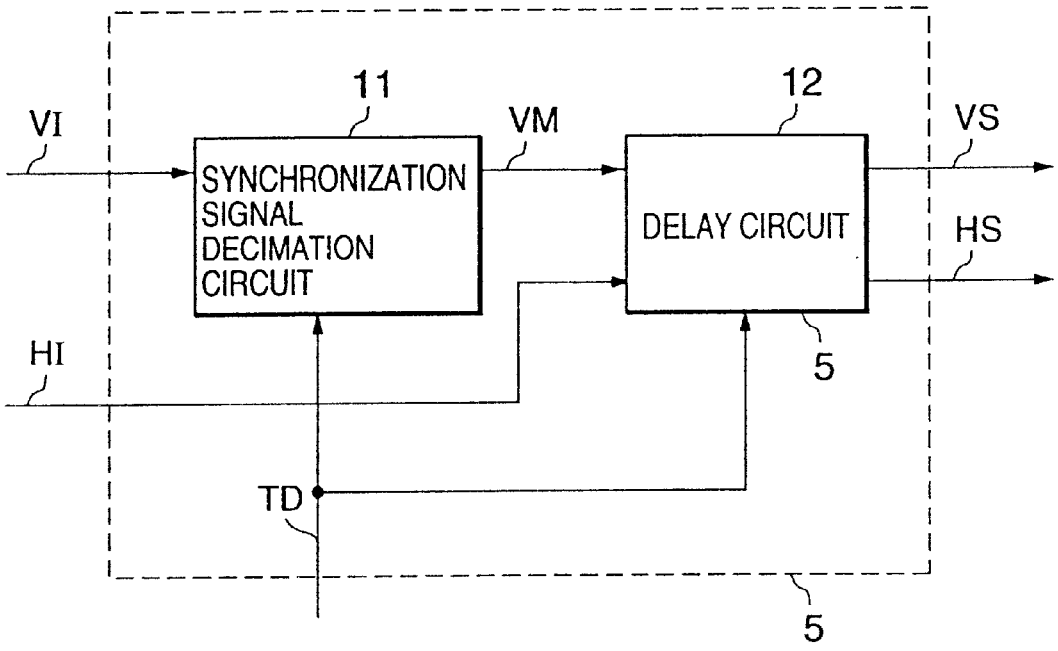
FIG. 2 is a block diagram showing configuration of a synchronizing signal processing circuit shown in FIG. 1.

FIG. 2 is a block diagram showing configuration of the synchronizing signal processing circuit 5 shown in FIG. 1. As shown in FIG. 2, the synchronizing signal processing circuit 5 has a synchronizing signal decimation circuit 11 and a delay circuit 12. In FIG. 2, VM represents a vertical synchronizing signal processed by the synchronizing signal decimation circuit 11.

Figure 3:
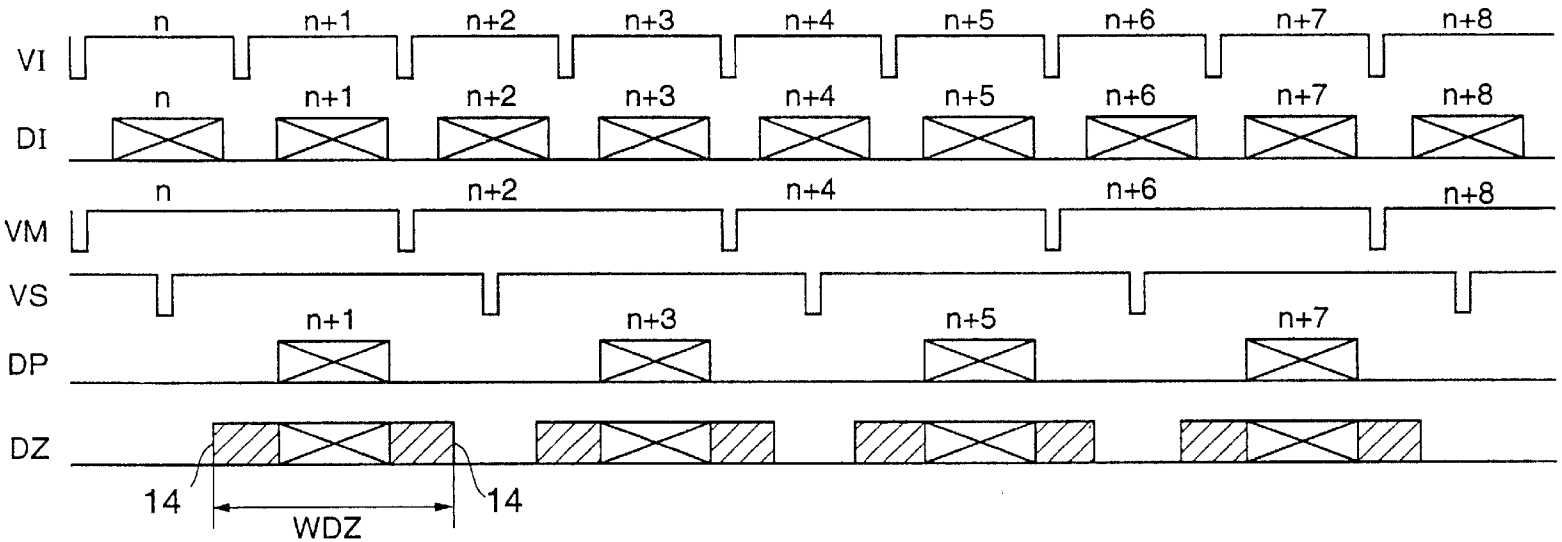
FIG. 3 is a timing chart showing decimation, delay processing, and scale-up processing in the image display apparatus of the first embodiment.
Figure 4A:
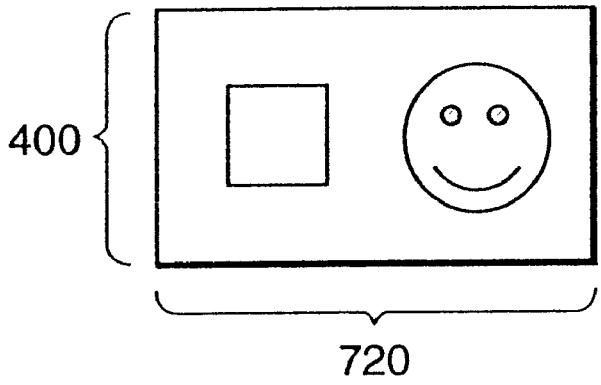
Figure 4B:
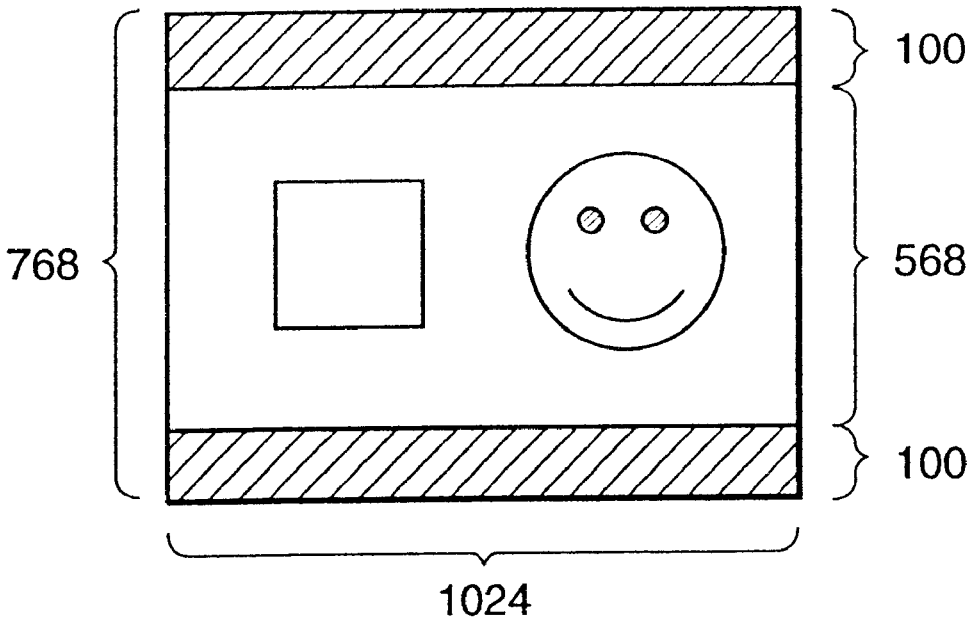

FIG. 3 is a timing chart for explaining decimation, delay processing, and scale-up processing in the image display apparatus of the first embodiment. In FIG. 3, n to n+8 (n is a positive integer) represent frame numbers of the input image signals. FIGS. 4A and 4B are diagrams for explaining an image display method of the image display apparatus of the first embodiment. FIG. 4A shows the numbers of vertical and horizontal pixels of the input image signal while FIG. 4B shows the numbers of vertical and horizontal pixels of the display panel, displayed image, and margin.

The operation of the image display apparatus of the first embodiment will next be described. As shown in FIG. 1, the vertical synchronizing signal VI is input to the terminal 3. The horizontal synchronizing signal HI is input to the terminal 2. To the terminal 1, the image signal DI sampled at preset intervals is input. The image signal DI is, for instance, an image signal consisting of three primary colors R, G, and B. The image signal DI may be the result of A/D conversion of an analog signal or received data of a digital signal. The image signal DI is synchronized with the horizontal synchronizing signal HI and the vertical synchronizing signal VI.

The horizontal synchronizing signal HI and the vertical synchronizing signal VI are input to the input signal measurement circuit 4 and the synchronizing signal processing circuit 5. The image signal DI is input to the input signal measurement circuit 4 and the image decimation circuit 7.

The input signal measurement circuit 4 measures frequencies, pulse widths, and polarities of the horizontal synchronizing signal HI and the vertical synchronizing signal VI, and the positions of the upper, lower, right, and left ends of the image signal, and outputs measurement results RD. The measurement results RD produced by the input signal measurement circuit 4 are input to the controller 6.

The controller 6 identifies the type of the input image signal according to the measurement results RD and judges whether decimation of the vertical synchronizing signal VI is needed, according to the type of the input image signal, display size of the display panel 10, and the frequency of the input vertical synchronizing signal VI. The controller 6 generates the control signal TD, which includes the judgment result and the control information for displaying a scaled-up image in a preset position of the display panel 10. The control signal TD produced by the controller 6 is input to the synchronizing signal processing circuit 5, the image decimation circuit 7, and the driving circuit 8.

The synchronizing signal processing circuit 5 will next be described with reference to FIG. 2. As shown in FIG. 2, the vertical synchronizing signal VI is input to the synchronizing signal decimation circuit 11. The horizontal synchronizing signal HI is input to the delay circuit 12. The control signal TD is input to the synchronizing signal decimation circuit 11 and the delay circuit 12.

The synchronizing signal decimation circuit 11 performs decimation of the input vertical synchronizing signal VI according to the input control signal TD and produces the decimated vertical synchronizing signal VM. The decimated vertical synchronizing signal VM produced by the synchronizing signal decimation circuit 11 is input to the delay circuit 12.

The delay circuit 12 performs delay processing of the decimated vertical synchronizing signal VM according to the input control signal TD and the horizontal synchronizing signal HI, and produces the result as the delayed vertical synchronizing signal VS. The delay circuit 12 also generates the horizontal synchronizing signal HS which has a certain positional relationship with the delayed vertical synchronizing signal VS, according to the horizontal synchronizing signal HI. The vertical synchronizing signal VS and the horizontal synchronizing signal HS generated by the synchronizing signal processing circuit 5 are input to the image decimation circuit 7 and the driving circuit 8.

The image decimation circuit 7 performs decimation of the input image signal DI according to the control signal TD, based on the vertical synchronizing signal VS and the horizontal synchronizing signal HS subjected to the delay processing, and produces the decimated image signal DP. The image signal DP generated by the image decimation circuit 7 is input to the image scale-up circuit 9. The driving circuit 8 generates the drive signal SP for the display panel 4 corresponding to the scale-up display of the image, according to the horizontal synchronizing signal HS, the vertical synchronizing signal VS decimated by the synchronizing signal processing circuit 5, and the control signal TD output by the controller 6. The drive signal SP generated by the driving circuit 8 is input to the image scale-up circuit 9 and the display panel 10. The image scale-up circuit 9 scales up the image according to the drive signal SP and inputs the scaled-up image signal DZ to the display panel 10. The display panel 10 displays the image signal DZ output by the image scale-up circuit 9 according to the drive signal SP output by the driving circuit 8.

The operation of the controller 6 will next be explained in further details. In the example used for the explanation, the input image signal DI pertains to an image portion of 720 pixels wide by 400 lines high, as shown in FIG. 4A, and a frame of 900 pixels wide by 449 lines high, including non-image area, and the display panel is 1024 pixels wide by 768 lines high, as shown in FIG. 4B.

The controller 6 first calculates the scaling factor of the image. The scaling factor can be specified in many ways. One exemplary way described here is a way of displaying the input image signal DI as large as possible on the display panel 10 with no missing part of the image and maintaining the aspect ratio. In this case, the smaller of the vertical scaling factor of 1.92 (=768 pixels/400 pixels) and the horizontal scaling factor of 1.42 (=1024 lines/720 lines), which are calculated to scale up the input image signal DI to the whole display panel 10, should be used as both vertical and horizontal scaling factors. That is, 1.42 is used as the vertical and horizontal scaling factors. The scaled-up image is 1024 pixels wide by 568 lines (=400 lines×1.42) high.

Next, the controller 6 judges whether the decimation of the vertical synchronizing signal VI and the image signal DI is required. With the image scaling factor of 1.42 calculated above, the number of lines for the image signal DI in a single frame including non-image area is 637.58 lines 449 lines (=1.42). The fractional portion is a height smaller than the preset line width. Accordingly, a total of 637 lines are included in the period of a single frame in real terms. Because the total number of lines is smaller than the height of the display panel 10, which is 768 lines, the image is not appropriately displayed on the display panel 10. The controller 6 compares the total number of lines of a single frame after image scale-up with the number of lines of the display panel 10. If the former is smaller, the controller generates the control signal TD that includes information providing instructions to perform decimation of the vertical synchronizing signal VI and image signal.

The controller 6 generates the control signal TD which includes information of an instruction for delaying decimated vertical synchronizing signal VM for a preset period so that the scaled-up image can be partly displayed in a desired position of the display panel 10. To display the image area in the center of the display panel 10, for instance, a non-image area of 100 lines must be displayed each in the upper end and lower end of the display panel 10. To enable this, the delay circuit 12 is controlled through the control signal TD in search of such a delay value that a period of at least 100 lines can be maintained between the delayed vertical synchronizing signal VS and the top of the image of the image signal DP and that a period of 100 lines or more can be maintained between the end of the image of the image signal DP and the vertical synchronizing signal VM. The control signal TD for starting the image area from the 101st line of the whole display area of the display panel is also generated to control the driving circuit 9.

Since a width of a margin (non-image area) can be calculated from a size of the input image and a size of the display panel 10, the image can always be displayed in the center of the display panel 10 even if the operation described above causes the type of the input image signal to be changed. Alternatively, the image can also be displayed in the upper end, lower end, or any other desired position on the display panel 10.

Next, the operation of the synchronizing signal decimation circuit 11, the synchronizing signal delay circuit 12, and the image decimation circuit 7 will be described with reference to FIG. 3. In the decimation performed by the image decimation circuit 7, the image decimation circuit 7 selects a predetermined frame among first to N-th frames of sequentially input image data (N represents a frame number which is a certain integer not smaller than 2) outputs the selected frame of image data, and discards image data other than the selected frame of image data. In the decimation performed by the synchronizing signal decimation circuit 11, the synchronizing signal decimation circuit 11 selects a predetermined frame among first to N-th frames of sequentially input vertical synchronization signals, outputs the selected frame of vertical synchronizing signal, and discards vertical synchronizing signals other than the selected frame of vertical synchronizing signal. A frame number of the selected frame of image data is different from a frame number of the selected frame of vertical synchronizing signal. N is 2, for instance. According to the control signal TD output from the controller 6, the synchronizing signal decimation circuit 11 decimates the input vertical synchronizing signal VI at a ratio of one frame to two frames and produces the decimated vertical synchronizing signal VM. The vertical synchronizing signals VI of frames n+1, n+3, n+5, n+7, and so on are discarded. The delay circuit 12 delays the input vertical synchronizing signal VM for a certain period of time, according to the control signal TD output by the controller 6, and generates the delayed vertical synchronizing signal VS.

The image decimation circuit 7 decimates the image signals, frames of the decimated image signals being different from the frames of which vertical synchronizing signal VI were decimated, according to the control signal TD output by the controller 6, on the basis of the vertical synchronizing signal VS and the horizontal synchronizing signal HS. As shown in FIG. 3, the image signals DI of frames n, n+2, n+4, n+6, n+8, . . . are discarded, and the decimated image signals DP (frames n+1, n+3, n+5, n+7, . . . ) are output.

The operation of the image scale-up circuit 9 and the display panel 10 will next be described with reference to FIG. 3. The image scale-up circuit 9 scales up the image according to the drive signal SP generated by the driving circuit 8 and outputs the scaled-up image signal DZ. In FIG. 3, the shaded boxes 14 of DZ correspond to non-image areas displayed on the display panel 10, wherein preset monochromatic data is displayed.

In the image display apparatus of the first embodiment, the input image signal DI of 720 pixels wide by 400 lines high as shown in FIG. 4A, for instance, is displayed on the display panel 10 of 1024 pixels wide by 768 lines high as shown in FIG. 4B. The input image is scaled up to an image of 1024 pixels wide by 568 lines high with the same aspect ratio maintained. By providing a non-image area of 100 lines each in the upper and lower ends of the display panel 10, the scaled-up image is displayed in the center of the display panel 10. Decimation degrades the image quality, but if the input image is a still image, the quality of the decimated image can be similar to that of a non-decimated image.

If the image scaling factor is set to 1.0, the image of the input image signal DI is not scaled up, and an image according to the image signal DI can be displayed in the center or another preset position of the display panel 10.

In the explanation given above, the vertical synchronizing signals VI of the frames n+1, n+3, n+5, n+7, . . . and the image signals DI of frames n, n+2, n+4, n+6, n+8, . . . are discarded. However, the frames to be discarded are not limited to the examples given above. For instance, decimation may be performed in such a way that the vertical synchronizing signals VI of frames n+1, n+4, n+7, n+10, . . . and the image signals DI of frames n, n+3, n+6, n+9, n+12, . . . are output. It is advisable that the frames from which the vertical synchronizing signals VI are discarded and the frames from which the image data is discarded be determined according to the intervals of the decimated and delayed vertical synchronizing signal VS, width of the image signal DZ of a single frame output from the image scale-up circuit 9 (width WDZ in FIG. 3), and other factors.

As has been described above, a correct scaled-up image having the same aspect ratio as the input image can be displayed on the display panel 10, using no expensive frame memory even if the image size of the display panel 10 is larger than the image size of the input image signal and even if the input image and display panel 10 have different aspect ratios.

Second Embodiment

Figure 5:
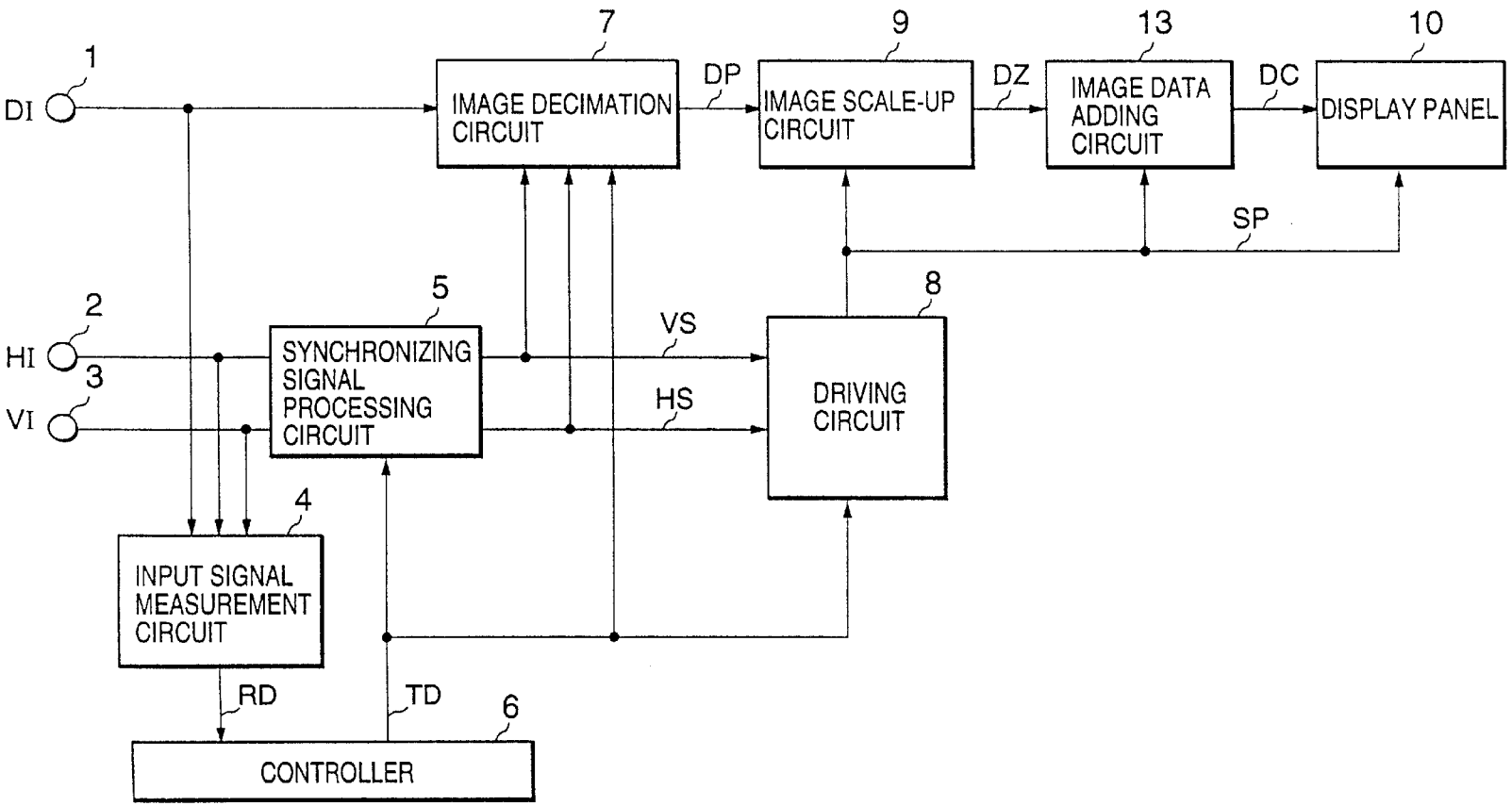
FIG. 5 is a block diagram showing configuration of an image display apparatus according to a second embodiment of the present invention.

FIG. 5 is a block diagram showing configuration of an image display apparatus according to a second embodiment of the present invention. As shown in FIG. 5, the image display apparatus of the second embodiment is different from the image display apparatus of the first embodiment described above only in that an image data adding circuit 13 is added. In FIG. 5, DC represents the image signal processed by the image data adding circuit 13.

The operation of the image data adding circuit 13 will next be described. As shown in FIG. 5, the image data adding circuit 13 is supplied with the drive signal SP output by the driving circuit 8 and the image signal DZ output by the image scale-up circuit 9. The image data adding circuit 13 puts a preset color on the non-image area of the image signal DZ displayed on the display panel 10 according to the drive signal SP. The image data adding circuit 13 further puts on the information display image data, notably the OSD (on-screen display) function, and outputs the image signal DC with superimposed coloring and information display image data. The image signal DC is input to the display panel 10, and the display panel 10 displays the image signal DC according to the drive signal SP output by the driving circuit 8.

The image display apparatus of the second embodiment can put a preset color on the margins (non-image areas) of the display panel 10. The color of margins of the display panel 10 can be changed to any color desired by the user in the partial image display.

Figure 6:
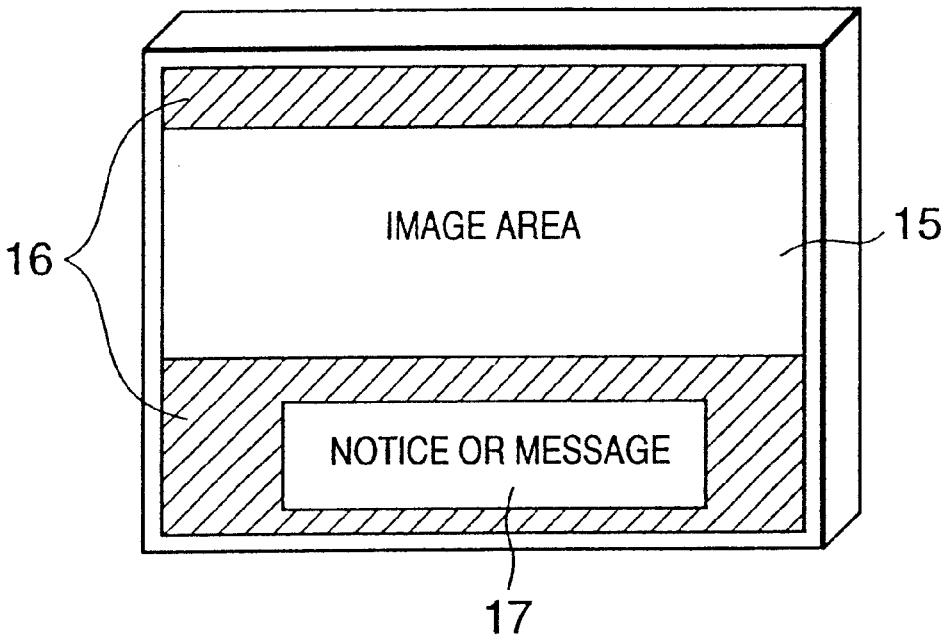
FIG. 6 is a diagram illustrating the image display method of the image display apparatus of the second embodiment.
Figure 7:
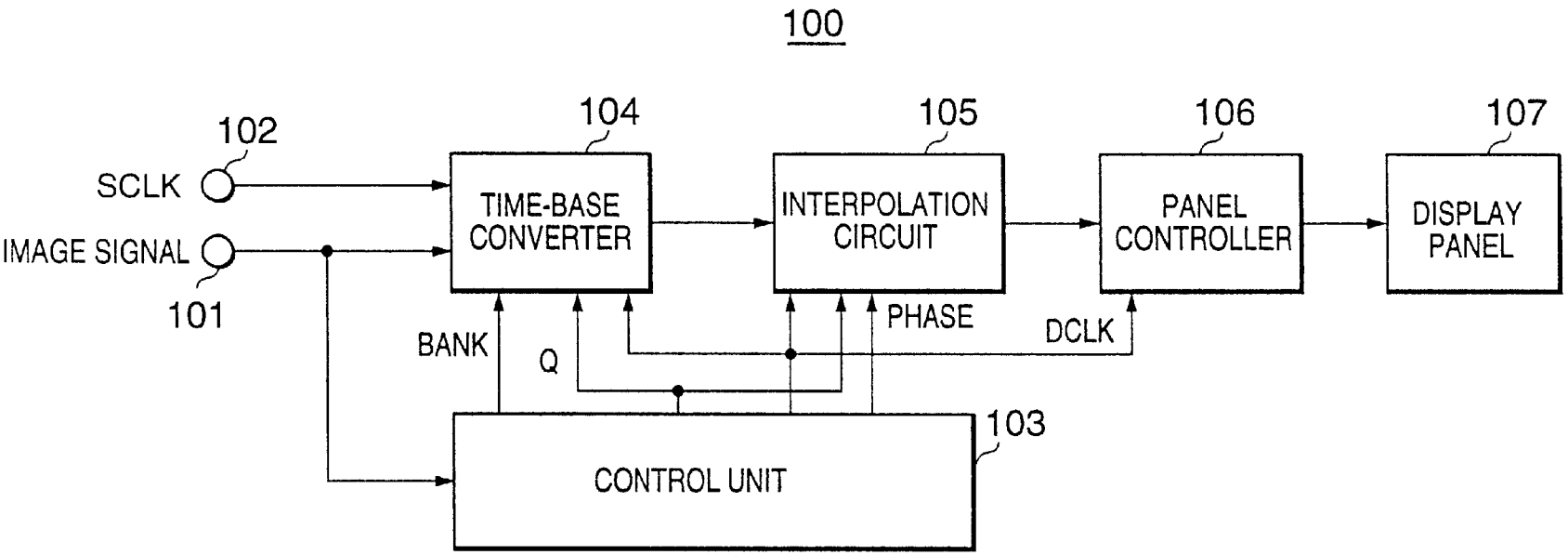
FIG. 7 PRIOR ART
FIG. 7 is a block diagram showing configuration of the prior art image display apparatus.
Figure 8:
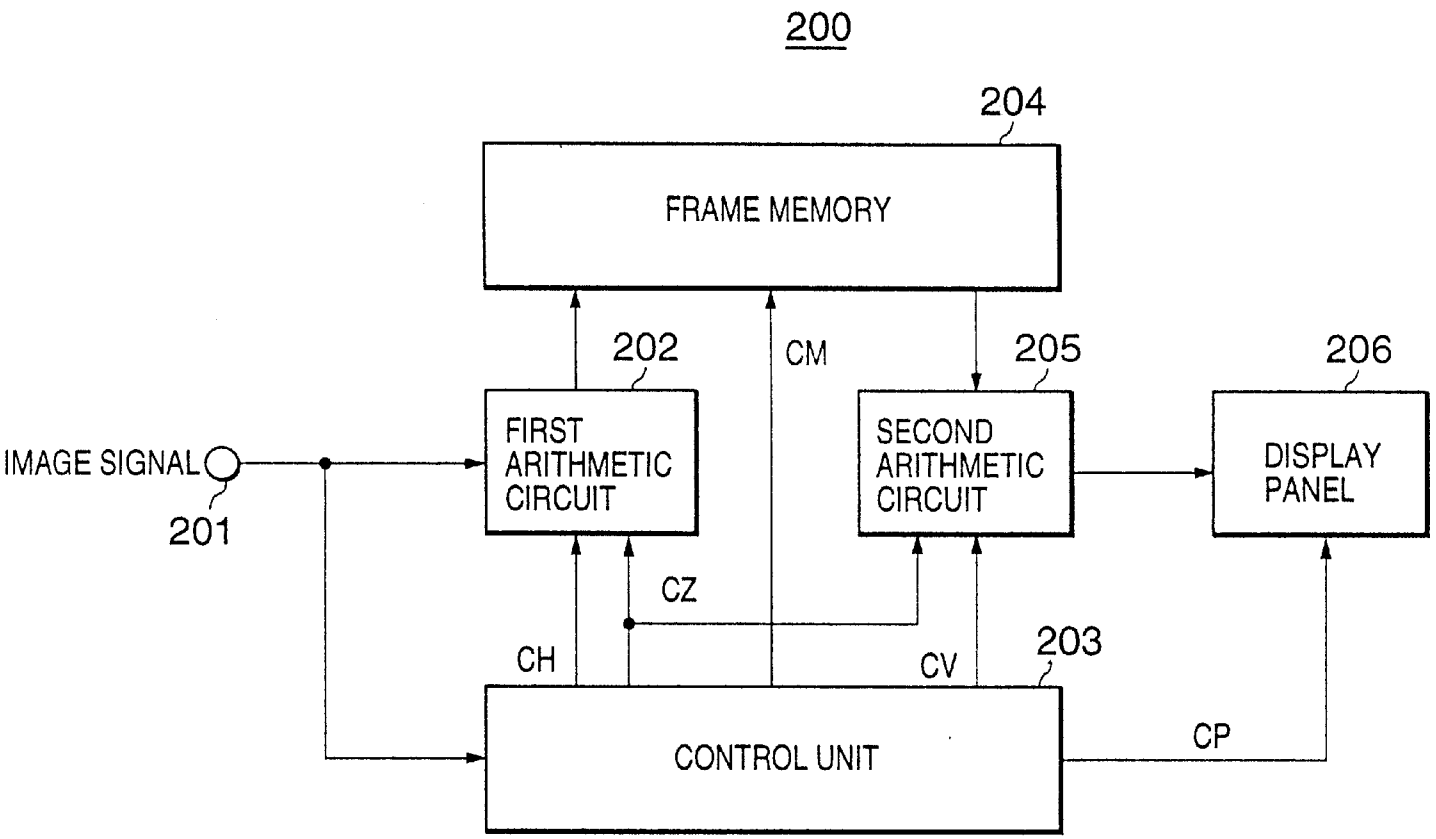
FIG. 8 PRIOR ART
FIG. 8 is a block diagram showing configuration of another prior art image display apparatus.
Figure 9A:
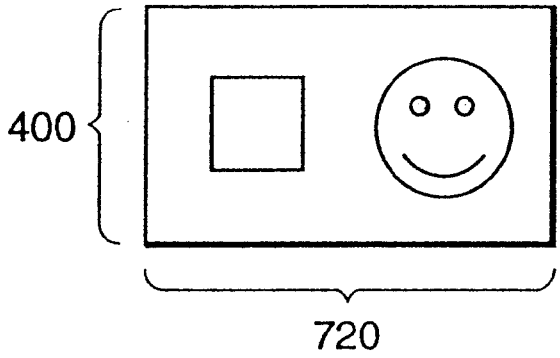
FIG. 9A PRIOR ART
Figure 9B:
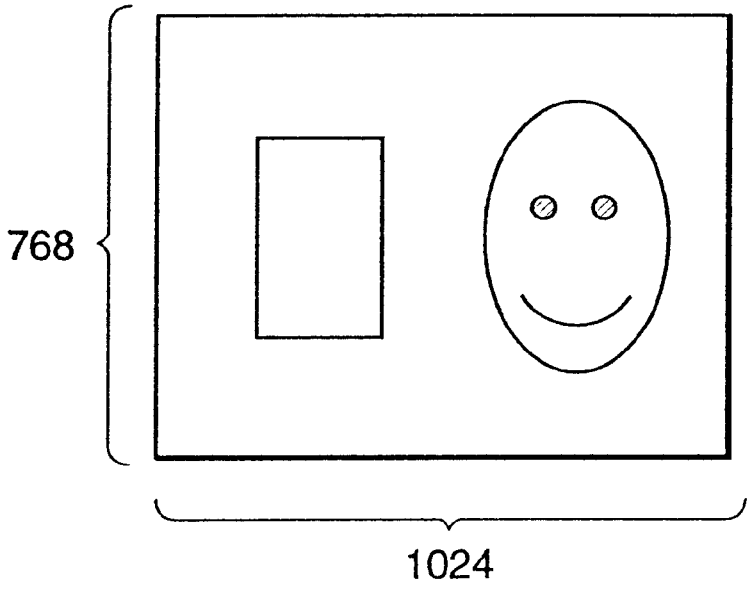
FIG. 9B PRIOR ART

FIG. 6 illustrates an image display method of the image display apparatus of the second embodiment. As shown in FIG. 6, the image display apparatus displays a scaled-up image of the input image signal DI in the area 15 of the display panel 10. A reference numeral 16 denotes a margin (non-image area) of the display panel 10. Moreover, the image display apparatus can display a message 17 warning that a decimated image is displayed in a part of the display panel 10 or a note telling that the aspect ratio of the input image signal DI is different from that of the display panel 10, persuading the user to change the type of the input image signal.

The second embodiment is the same as the first embodiment except for the points described above.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. An image display method comprising:

generating a synchronization for performing decimation of input vertical synchronizing signals to output decimated vertical synchronizing signals;

decimating input image data to output decimated image data;

scaling up the decimated image data to output scaled-up image data;

displaying an image on a display panel;

sequentially displaying individual frames of image according to the scaled-up image data in synchronization with the decimated vertical synchronizing signals; and processing information of a scaling factor of an image scale-up circuit, vertical synchronizing signals to be discarded by an synchronizing signal decimation circuit, and image data to be discarded by an image decimation circuit, a controller controlling operation of said synchronizing signal decimation circuit, an image decimation circuit, an image scale-up circuit, and a driving circuit according to the information.

2. The image display method of claim 1, further comprising performing delay processing on the vertical synchronizing signals to output delayed vertical synchronizing signals to said driving circuit.

3. The image display method of claim 1, wherein the scaling factor of said image scale-up circuit is determined according to a size of the input image data for a single frame and a size of an effective display area of said display panel.

4. The image display method of claim 1, wherein said controller determines vertical synchronizing signals to be discarded by said synchronizing signal decimation circuit and image data to be discarded by said image decimation circuit according to a size of the input image data for a single frame, a size of an effective display area of said display panel, and a frequency of the input vertical synchronizing signals.

5. The image display method of claim 2, wherein said controller determines vertical synchronizing signals to be discarded by said synchronizing signal decimation circuit, a delay time by a delay circuit, and image data to be discarded by said image decimation circuit according to a size of the input image data for a single frame, a size of an effective display area of said display panel, a frequency of the input vertical synchronizing signals, and an image display position in the effective display area of said display panel.

6. The image display method of claim 1, wherein decimation performed by said image decimation circuit selects a predetermined frame among first to N-th frames of sequentially input image data, N representing a frame number which is a certain integer not smaller than 2, outputs the selected frame of image data, and discards image data other than the selected frame of image data, decimation performed by said synchronizing signal decimation circuit, said synchronizing signal decimation circuit selects a predetermined frame among first to N-th frames of sequentially input vertical synchronization signals, outputs the selected frame of vertical synchronizing signal, and discards vertical synchronizing signals other than the selected frame of vertical synchronizing signal, and a frame number of the selected frame of image data is different from a frame number of the selected frame of vertical synchronizing signal.

7. The image display method of claim 1, further comprising an image data adding step for displaying a certain color at an area other than the image based on the image data in the effective display area of said display panel.

8. The image display method of claim 1, further comprising an image data adding step for displaying a message indicating that a displayed image is based on the decimated vertical synchronizing signals and the decimated image data when said image decimation circuit performs decimation of the image data.

* * * * *